US005442929A

United States Patent [19]

Gillin

[11] Patent Number: 5,442,929

[45] Date of Patent: Aug. 22, 1995

[54] CRYOGENICALLY-TREATED ELECTRICAL CONTACTS

[75] Inventor: James P. Gillin, Marlton, N.J.

[73] Assignee: Repco Inc., Cherry Hill, N.J.

[21] Appl. No.: 95,966

[22] Filed: Jul. 22, 1993

[51] Int. Cl.[6] ..... F25D 25/00

[52] U.S. Cl. ..... 62/62; 62/259.2; 29/622; 29/825; 29/877; 200/268

[58] Field of Search ..... 62/62, 259.2, 51.1, 62/64; 29/622, 825, 877; 200/268

[56] References Cited

U.S. PATENT DOCUMENTS

| | | | |
|---|---|---|---|
| 4,777,804 | 10/1988 | Bowling et al. | 62/303 |
| 4,872,322 | 10/1989 | Woods et al. | 62/51.1 |
| 4,874,430 | 10/1989 | Bornstein | 75/234 |
| 5,174,122 | 12/1992 | Levine | 62/50.2 |

OTHER PUBLICATIONS

"Deep Freeze Promises Violin Strings New Life," *Boston Herald,* Nov. 29, 1988.

"Out in the Cold," *Omni,* Mar. 1989, p. 40.

"Cold Strings Warm Music's Tones," *The Worcester [Mass.] Evening Gazette,* Feb. 21, 1989, p. D5.

"Using Process Controls for Cryogenic Accuracy," *Heat Treating,* Jul. 1991, p. 19.

"Frozen Tools," *Popular Science,* vol. 230, No. 6, Jun. 1987, p. 64.

Museatex Cryogenics Inc., Montreal Canada, advertisement brochure (3 sheets).

"The CP-100 Cryoprocessor From Applied Cryogenics Inc.," Applied Cryogenics Inc., Newton, Mass. (3 sheets).

"Extended Life for Tooling and Wear Parts," Applied Cryogenics Inc., Newton, Mass. (4 sheets).

*Primary Examiner*—Ronald C. Capossela

*Attorney, Agent, or Firm*—Dann, Dorfman, Herrell and Skillman

[57] ABSTRACT

The useful life of electrical contacts is extended by a cryogenic treatment. An electrical contact is exposed to a low temperature, such as below 172 K for a selected period of time. The low temperature may be obtained via a controlled rate of cooling. After the contact has been exposed to the low temperature, the contact may be returned to ambient temperature at a controlled rate. The cryogenic treatment results in extended useful life of contacts made of materials such as copper and of composite contacts incorporating silver, refractory metals, and metal oxides such as cadmium oxide and tin oxide.

40 Claims, 1 Drawing Sheet

CRYOGENICALLY-TREATED ELECTRICAL CONTACTS

FIELD OF THE INVENTION

The present invention relates to an electrical contact having an extended life. More specifically, the invention relates to a cryogenic treatment for extending the useful life of an electrical contact.

BACKGROUND OF THE INVENTION

Mechanical devices that are used to control electrical current, such as relays, switches, contactors, and circuit breakers, rely upon electrical contacts to make and the break the flow of current. Electrical contacts usually include two conductive members which are arranged to engage and make contact in a particular way so that electricity flows across the junction between the engaged contacting surfaces of the contacts with relatively little loss. The contacting surfaces of electrical contacts are commonly engaged by such actions as impact, wiping, and/or rolling. Regardless of the particular type of mechanical action employed, electrical contacts are subject to several damage and failure mechanisms.

The making and breaking action of electrical contacts is often accompanied by plasma generation, or arcing, between the contacting surfaces of the contacts as they are opened and/or closed. Such arcing can damage the contacting surfaces by causing pitting, transfer of material, or promoting undesirable chemical reactions such as oxide formation. These arc-induced damage mechanisms can aggravate impact and/or frictional wear of the contacting surfaces due to the mechanical action of the contact. The useful life of an electrical contact, i.e. the number of switching operations or the length of time that the contact functions before exhibiting mechanical failure or unacceptably high electrical resistance, is limited by the deleterious effects of the various damage mechanisms upon the electrical characteristics of the contacts.

Electrical contacts are often made of a copper base. Copper is a relatively good electrical and thermal conductor and in low current applications, such as household current switching, acceptable contacts may be formed entirely of copper. However, for switching currents of higher magnitudes, such as the currents required by industrial motors, contacting surfaces of copper possess unacceptable properties. Copper contacting surfaces tend to form resistive oxide complexes which detract from switching performance. Additionally, copper contacting surfaces tend to weld together when used to conduct even moderately high current densities. Depending on severity, the welding together of contact surfaces can cause delayed turn-off response of relays or, in the worst case, can cause the contact connections to become permanently joined together making switching completely inoperable. Hence, several material compositions having acceptable physical properties have been formulated for use as contacting surface materials for electrical contacts. Silver alloys and solid suspensions have become popular compositions for use in contact surfaces of electrical contacts because silver has high electrical conductivity and high heat capacity. In order to produce contacting surfaces that are strong, resist wear, and have a reduced tendency to weld, silver is commonly used in conjunction with other metals, such as nickel, palladium, and tungsten. Silver is also used with metal oxides, such as oxides of cadmium and of tin and in chemical combination with other elements such as in silver carbide. Contacting surface compositions have been applied to copper contacts by riveting, welding, brazing, or sintering the selected composition onto the contacts in order to form contacting surfaces having shapes and sizes desired for various applications.

Still other techniques to extend contact life have focussed on the environment in which the contacts operate. In some switching devices, the contacts are located within sealed environments containing a vacuum or an inert atmosphere to reduce surface oxidation of the contacts. Sealed environments also prevent foreign material, such as dust, from accumulating upon or between electrical contacts and contributing to contact surface degradation. Various lubricants have also been used to reduce surface oxidation and to reduce wear. Despite such efforts, even highly specialized electrical contacts require periodic replacement or refurbishing due to deterioration of the contacting surfaces.

In accordance with the present invention, a method is provided that extends the useful life of electrical contacts in order to reduce the expense and inconvenience of replacement or repair of the contacts.

SUMMARY OF THE INVENTION

In accordance with the present invention, a method for the cryogenic treatment of electrical contacts is provided. Electrical contacts treated in accordance with the present invention demonstrate an increased useful life relative to untreated contacts of the same type. More specifically, the useful life of an electrical contact may be extended significantly by exposing the contact to a predetermined relatively low temperature, for example below about 172 K, for a selected period of time.

In order to prevent damage to the contact from thermal cycling, the contact is cooled from ambient room temperature to the predetermined low temperature at a selected cooling rate, such as an average cooling rate greater than −74 K/h and preferably between about −38 K/h and about −28 K/h. The contact is then maintained at the predetermined temperature, such as below 172 K, for a selected time period, such as at least three hours. After the contact has been exposed to the predetermined low temperature, the contact is then returned to ambient temperature at a selected return rate which may be of equivalent magnitude relative to the cooling rate (i.e., between about 28 K/h and about 38 K/h). A slower return rate, such as between about 4.5 K/h to about 7.3 K/h, may also be used.

BRIEF DESCRIPTION OF THE DRAWING

The foregoing summary, as well as the following detailed description of preferred embodiments of the present invention, will be better understood when read in conjunction with the accompanying drawing, in which.

DETAILED DESCRIPTION OF THE PREFERRED EMBODIMENTS

Figure 1:
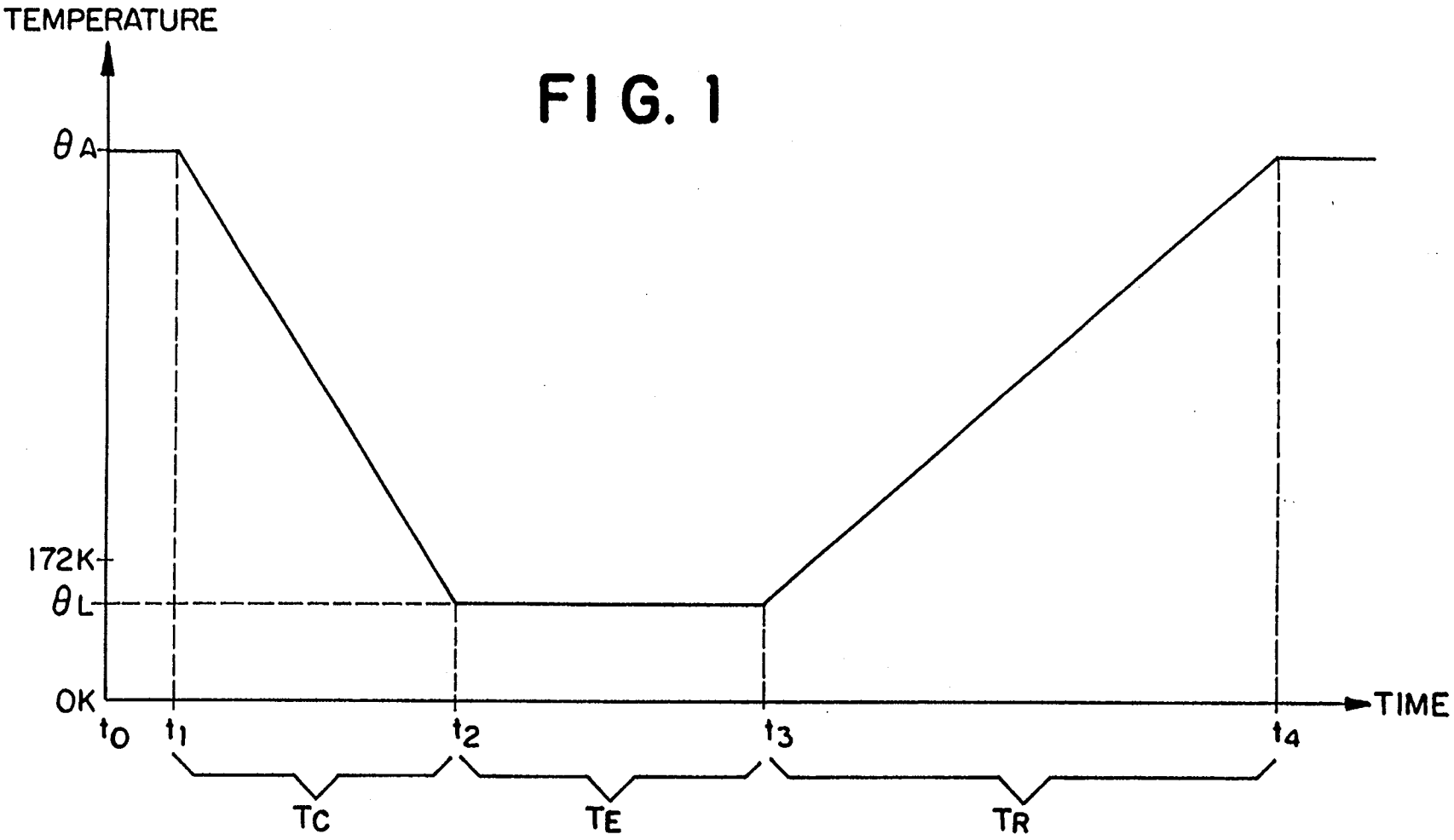
FIG. 1 is a graph of a thermal schedule for the cryogenic treatment for extending the useful life of an electrical contact.

Within mechanical and electromechanical devices that control or switch electrical currents, electrical contacts are used to make and to break electrical circuits. An electrical contact is an electrically conductive member having a contacting surface for engaging a corresponding contacting surface upon another contact at a junction of contact so that electrical current can flow across the junction. Electrical contacts are typically categorized as solid contacts or composite contacts. A solid contact is an electrical contact which is formed of a single material. A composite contact is an electrical contact formed of a backing material to which a contacting surface composition is applied to form the contacting surface of the contact. Copper is commonly used to form solid electrical contacts for low current applications such as household current switching. Other metals, such as brass and steel are also occasionally used to form electrical contacts. However, copper and other solid metallic contact materials often exhibit attributes, such as malleability or a tendency to form resistive surface oxide complexes, which render them unsuitable or undesirable for use as electrical contact materials in applications demanding frequent switching, large impact or frictional forces associated with contact engagement, high currents or transients, high voltages, or harsh physical or chemical environments. For these applications in which solid contacts are undesirable composite electrical contacts are employed having contacting surfaces that a often formed of refractory metals, highly conductive metals, or non-corroding metals.

Refractory metals include such metals as tungsten and molybdenum which have high melting points, low vapor pressures, and high resistance to welding, pitting, and arc erosion. They are usually employed in applications where operation is continuous or very frequent, where closing forces are relatively high, and where there are appreciable peak voltages due to load inductance. The refractory metals have a tendency to form highly resistive oxides at elevated temperatures and under severe arcing conditions. In order to minimize the influence of such oxides, high closing forces or a wiping engagement action may be used in systems employing refractory metal contact surfaces.

Among the highly conductive metals, silver has high thermal and electrical conductivity under usual ambient conditions. Although silver also forms an oxide, the silver oxide decomposes at relatively low temperatures, so that a low contact resistance is maintained. Pure silver, however, is relatively soft, has a low melting point, and tends to form a resistive surface sulphide layer (tarnish).

Non-corroding metals include platinum, palladium, and gold. These metals are most useful for forming contact surfaces for applications involving harsh chemical environments. Extremely light contact forces are necessitated by the softness of these metals in a pure state. The non-corroding metals are usually alloyed with iridium or ruthenium to impart greater hardness to the contacts.

Several compositions have been developed which balance the advantages and disadvantages of the refractory metals, the highly conductive metals, and the non-corroding metals. Silver is often alloyed with metals such as tungsten, molybdenum, nickel, cadmium, palladium and other metals in order to reduce sticking, to lessen arc-induced transfer, and to provide greater resistance to strain and wear than is exhibited by pure silver. Silver is also commonly combined with metal oxides such as cadmium oxide or tin oxide in order to increase the melting point of the contacting surface composition. Techniques for fabricating solid silver-based contacts containing a dispersion of cadmium oxide and nickel particles are known.

Silver compositions may also be applied to a backing material, such as copper, for example, electrolytically-refined copper or oxygen-free copper, in order to form composite electrical contacts. The method by which a contacting surface is applied to a backing depends upon the operating requirements of the system in which the contact is to be employed. Methods of fabricating a composite contact include: mechanically fastening a button or rivet of the selected contacting surface composition to the backing; securing the contacting surface onto the backing with an intervening brazing material or by direct welding techniques such as percussion welding; or pressing and sintering a powdered mixture of the composition onto the backing. The contacting surfaces of electrical contacts are often machined either before or after attachment to the backing. For example, in relays which employ a stationary contact and a moving contact, the contacting surface of the stationary contact is often flat while the contacting surface of the moving contact often has a convex crown or radius.

In accordance with the present invention, the useful life of the contacting surface of an electrical contact is significantly extended by exposing the contact to a temperature below about 172 K. The life of composite contacts wherein the contacting surface is applied in the form of a button or other separate piece may be extended by treating the entire assembled contact or the contacting surface alone. It is preferable to treat assembled composite contacts since the benefits afforded by cryogenic treatment may be lessened by subsequent working of the treated contacting surface in accordance with the particular contact assembly technique required. Treatment of electrical contacts applies to the improvement of the contacting surfaces of solid contacts as well as to composite contacts.

Significant extension of the useful life of electrical contacts has been observed by maintaining exposure of the electrical contacts below 172 K for a period of at least about 3 hours and preferably between about 8 hours to 12 hours. A useful temperature for producing such extended-life contacts is approximately 77 K since such a temperature may be easily and economically achieved via the use of liquid nitrogen as a coolant. Even lower temperatures may be used to treat electrical contacts by using such devices as cryostats employing more expensive coolants such as liquid neon or liquid helium. An apparatus such as a CP-100 cryoprocessor manufactured by Applied Cryogenics Incorporated of Newton, Massachusetts, may be used for exposing electrical contacts to temperatures on the order of 77 K and with an accuracy of ±5%. The CP-100 is a microprocessor-controlled apparatus which provides the ability to thermally cycle the contents of a payload chamber according to a programmable thermal ramp/soak schedule.

A thermal schedule for extending the useful life of an electrical contact is shown in FIG. 1. Initially, at time $t_0$, the electrical contact is at an ambient temperature, $\Theta_A$, which is usually room temperature or approximately 300 K. The contact may be enclosed within a sheath, such as a layer of aluminum foil, to cover the contacting surface and protects the contact from convection currents or other sources of thermal irregularities and to provide a uniform microclimate about the contact. Then, the contact is placed into the payload chamber of the cryoprocessor. Several contacts may also be placed into the payload chamber to be processed together.

After the contact is placed into the payload chamber, a selected cooling ramp is begun at time $t_1$. The contact is preferably cooled to a temperature $\Theta_L$ below 172 K at a selected cooling rate over a finite cooling period, $T_C$, that is long enough to avoid damage to the contact as may occur from thermal stress if the contact is cooled too quickly. The cooling period $T_C$ is completed when the contact reaches $\Theta_L$ at time $t_2$. A cooling period of at least 3 hours and preferably 6 to 8 hours has proven acceptable for reaching $\Theta_L$ of approximately 77 K without damaging contacts of various kinds. Such results define a preferred average cooling rate of greater than −74 K/h and preferably from about −38 K/h to about −28 K/h. Average cooling rates that are less than −74 K/h (i.e., rates of temperature decrease with a magnitude greater than 74 K/h) pose a risk of damaging the electrical contact due to thermal stress. The instantaneous cooling rate may vary during the cooling period, for example via alternating periods of rapid cooling and equilibration, in order to obtain the selected average cooling rate in a series of small steps.

Upon reaching $\Theta_L$, the contact is maintained at that temperature for an exposure period, $T_E$, of at least 3 hours and preferably between about 8 hours to 12 hours. The accuracy with which the contact is kept at $\Theta_L$ during the exposure period is not critical as long as the contact is kept below 172 K for the selected exposure period and the contact is not subjected to rapid thermal excursions that would cause thermal stress damage.

When the exposure period is completed at time $t_3$ the contact is returned to the ambient temperature $\Theta_A$ over a return ramp period $T_R$ ending at $t_4$. Alternatively, the contact may be allowed to return to a temperature somewhat below $\Theta_A$ provided that removal of the contact from the cryoprocessor and exposure to the ambient temperature does not damage the contact. The return ramp period is long enough to prevent damage to the contact and may be equal to the cooling ramp period $T_C$. Larger values of $T_R$ from about 30 hours to about 48 hours have proven effective for returning contacts to room temperature from a $\Theta_L$ of approximately 77 K. Such longer periods of time may be preferable if the thermal processing equipment is left unattended for long periods of time. These values of $T_R$ define an average return ramp rate of about 28K/h to 38 K/h and as low as 4.5 to about 7.3 K/h for extended return ramps. As described in connection with the cooling period, the return ramp period may include alternating periods of rapid warming and equilibration in a series of small steps rather than a continuous warming ramp as shown in FIG. 1. After the contact has been returned to $\Theta_A$, the contact is removed from the payload chamber of the cryoprocessor and is taken out of the sheath, if any. The contact is then ready for installation.

It has been observed that the contacting surfaces of cryogenically-treated composite contacts formed by powder metallurgical techniques exhibit superior abrasion resistance and adhesion to the backing than non-treated contacts. In one experiment, contact surface pads of a silver/cadmium oxide composition having a thickness of approximately 0.125 in. were sintered onto backings made of CDA-110 electrolytically-refined copper. The entire contacts were then plated with silver. A sample of the contacts were then cryogenically treated. Attempts were then made with a belt sander to impart convex crowns to the contacting surfaces upon samples of cryogenically-treated and untreated contacts. It was found that the silver composition could be completely removed from the untreated contacts in approximately 15 seconds. The treated contacts, in contrast, retained a layer of silver composition for as long as 15 minutes. Similar results showing superior adhesion or resistance to abrasion in cryogenically-treated contacts were also obtained for contacts having contacting surface compositions comprising silver and tungsten.

Electrical contacts which have been treated according to the present method have exhibited significantly extended useful lives relative to otherwise identical non-treated contacts. Extended useful lives have been particularly observed in contacts employed in devices for controlling electric motors. Electric motors are characterized by starting currents, or inrush currents, of short duration and high magnitudes relative to their steady-state operating currents. When electric motors are switched off, inductive impedance promotes arc formation between the switching contacts. The result of such operational characteristics is that the electrical contacts in motor control devices must be replaced or repaired frequently thus entailing direct expenses associated with such replacement or repair in addition to indirect expenses associated with the concomitant loss of service.

In one application,-cryogenically treated electrical contacts were tested in the control apparatus for circulation motors in an industrial pollution control system. The contacts were NEMA size 5 contacts of the Westinghouse GPA-GCA series. These contacts have an AC current rating of 300 A. The contacts were formed of a CDA-110 copper backing upon which 0.6 inch diameter pads of a silver tungsten composition were welded. The entire assembled contacts were then silver-plated. The conventional relay contacts which had been used to switch current to the motors required replacement at intervals of approximately every two months. The use of the cryogenically-treated contacts extended the replacement interval to thirty-nine months.

Cryogenically treated contacts have demonstrated significant extensions of useful life relative to other types of aftermarket or replacement contacts. A heavy duty washing machine installed in a hospital was used to test the performance of the original contacts, conventional replacement contacts, and cryogenically-treated contacts. The original contacts were NEMA size 1 AC reversing contacts manufactured by Furnas Inc. (Furnas part #75DF14). The contacts were formed with a silver cadmium oxide composition upon a copper backing. The original contacts and all of the replacement contacts that were tested failed within four months of installation. Cryogenically treated contacts were still operating after six months of use. Cryogenic treatment has been tested upon plain copper contacts. Cryogenic treatment has extended the replacement interval of plain copper electrical contacts in a household dumbwaiter from approximately every month to approximately every four months.

Cryogenically-treated copper contacts have been found to outlive composite contacts in some applications. The ability to replace composite contacts with solid copper contacts can lower the cost of replacement. In one test, untreated manufacturer-specified copper contacts having a fine silver pad were employed in a DC motor control unit aboard a TEREX Titan mining vehicle. These contacts exhibited a failure interval on the order of three to four weeks. Replacement contacts were formed of CDA-110 copper and then cryogenically treated. The treated copper contacts were still functioning after five months of use.

Cryogenic treatment has yielded significant lifetime extension for electrical contacts of commercially pure copper and for composite contacts of copper having contacting surface compositions of silver; alloys of silver with other metals, such as with palladium, nickel, tungsten, and molybdenum; suspensions of oxides such as cadmium oxide and tin oxide in silver; and chemical compounds such as silver carbide.

From the foregoing disclosure and the accompanying drawing, it can be seen that the present invention provides a method for producing an electrical contact which exhibits a significantly extended useful life as a result of exposure to a relatively low temperature. The terms and expressions which have been employed are used as terms of description and not of limitation and there is no intention in the use of such terms and expressions of excluding any equivalents of the features shown and described, or portions thereof, but it is recognized that various modifications are possible within the scope of the claimed invention.

That which is claimed is:

1. A method for preparing an electrical contact for use at a temperature above 172 K, said electrical contact of the type having a first contacting surface for physically engaging and disengaging a second contacting surface for making or breaking an electrical current, the method comprising the step of exposing said first contacting surface of the contact to an exposure temperature below 172 K for a predetermined time period for treatment and returning said first contacting surface to a temperature above 172K for use.

2. The method as in claim 1 wherein said exposing step includes the step of using liquid nitrogen to produce said exposure temperature.

3. The method as in claim 1 wherein said exposing step is conducted for the predetermined time period having an exposure time of at least three hours.

4. The method as in claim 3 wherein said exposure time is from about six hours to about eight hours.

5. An electrical contact prepared according to the method of claim 1 for use at a temperature above 172 K, the electrical contact having a first contacting surface.

6. The electrical contact of claim 5 wherein said first contacting surface comprises commercially-pure copper.

7. The electrical contact of claim 5 wherein said contact, including said first contacting surface, consists essentially of commercially pure copper.

8. The electrical contact according to claim 5 wherein said electrical contact is a composite contact, comprising:

a contact base of one material; and wherein said first contacting surface includes another material applied to said base, said contacting surface having been exposed to said exposure temperature below 172 K.

9. The electrical contact according to claim 8 wherein said contact base comprises copper and said first contacting surface includes a composition comprising silver.

10. The electrical contact of claim 9 wherein said composition further comprises a metal selected from a group consisting of cadmium, molybdenum, nickel, palladium, and tungsten.

11. The electrical contact of claim 9 wherein said composition further comprises a metal oxide.

12. The electrical contact of claim 11 wherein said metal oxide is selected from a group consisting of tin oxide and cadmium oxide.

13. The contact of claim 8 wherein said contact base consists essentially of electrolytically-refined copper.

14. The electrical contact according to claim 8 wherein said contact base comprises electrolytically-refined copper.

15. The electrical contact of claim 14 wherein said base consists essentially of electrolytically refined copper.

16. The electrical contact according to claim 5 wherein said first contacting surface includes a composition comprising silver.

17. The electrical contact according to claim 16 wherein said composition further comprises a refractory metal.

18. The electrical contact according to claim 16 wherein said composition further comprises a metal selected from a group consisting of cadmium, molybdenum, nickel, palladium and tungsten.

19. The electrical contact according to claim 16 wherein said composition further comprises an oxide.

20. The electrical contact according to claim 19 wherein said oxide is selected from a group consisting of tin oxide and cadmium oxide.

21. The method of claim 1 comprising the step of attaching said first contacting surface to a conductive base in order to assemble said contact.

22. The method of claim 21 wherein said attaching step is conducted after to said exposing step.

23. The method of claim 1 comprising the step of attaching said first contacting surface to a conductive base to assemble said contact, and exposing the assembled contact to said exposure temperature below 172 K for a predetermined time period.

24. A method for preparing an electrical contact for use at a temperature above 172 K, said electrical contact of the type having a first contacting surface for engaging and disengaging a second contacting surface for making or breaking an electrical current, the method comprising steps of:

(a) cooling said first contacting surface from an ambient temperature to an exposure temperature below 172 K;

(b) exposing said first contacting surface to said exposure temperature for a predetermined exposure time; and (c) returning said first contacting surface substantially to said ambient temperature after said exposing step.

25. The method as in claim 24 wherein said cooling step is conducted in a stepwise fashion.

26. The method as in claim 24 wherein said returning step is conducted in a stepwise fashion.

27. The method as in claim 24 wherein said cooling step is conducted at an average cooling rate greater than −74 K/h.

28. The method as in claim 27 wherein said average cooling rate is between about −38 K/h and −28 K/h.

29. The method as in claim 24 wherein said returning step is conducted at an average rate of at least about 4.5 K/h.

30. The method as in claim 24 wherein said cooling step is conducted over a cooling period of at least three hours.

31. The method as in claim 30 wherein said cooling period is from about six hours to about eight hours.

32. The method as in claim 24 wherein said returning step is conducted over a period of at least about 3 hours.

33. The method as in claim 24 further comprising the step of covering said first contacting surface with a sheath prior to said cooling step for providing a generally uniform microclimate during said exposing step.

34. The method of claim 24 wherein said exposure temperature is approximately 77 K.

35. The method of claim 24 comprising the step of maintaining said exposure temperature substantially constant during said exposure step.

36. The method of claim 35 wherein said exposure time is at least about one hour.

37. The method of claim 36 wherein said exposure time is from about 6 hours to about 8 hours.

38. The method of claim 37 wherein said cooling step and said returning step are conducted over periods of at least three hours each.

39. An electrical contact prepared for use at a temperature above 172 K according to the method of claim 38.

40. An electrical contact prepared for use at a temperature above 172 K according to the method of claim 24.

* * * * *